US008397684B2

(12) United States Patent
Yang et al.

(10) Patent No.: US 8,397,684 B2
(45) Date of Patent: Mar. 19, 2013

(54) VARIABLE COMPRESSION RATIO APPARATUS

(75) Inventors: Jei Choon Yang, Yongin-si (KR); Yen Wha Ryu, Hwaseong-si (KR); Eun Ho Lee, Hwaseong-si (KR); Jin Kook Kong, Suwon-si (KR); Soo Hyung Woo, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 341 days.

(21) Appl. No.: 12/946,234

(22) Filed: Nov. 15, 2010

(65) Prior Publication Data

US 2012/0000444 A1 Jan. 5, 2012

(30) Foreign Application Priority Data

Jun. 30, 2010 (KR) ..... 10-2010-0063135

(51) Int. Cl.

| | |
|---|---|
| ***F02B 75/04*** | (2006.01) |
| ***F02B 75/26*** | (2006.01) |
| ***F02B 1/00*** | (2006.01) |
| ***F02B 41/04*** | (2006.01) |
| ***F02D 15/02*** | (2006.01) |
| ***F02D 15/04*** | (2006.01) |

(52) U.S. Cl. ..... 123/48 R; 123/48 B; 123/78 R; 123/78 B; 123/78 BA; 123/78 E

(58) Field of Classification Search ..... 123/48 R, 123/48 B, 78 R, 78 B, 78 BA, 78 E
See application file for complete search history.

(56) References Cited

U.S. PATENT DOCUMENTS

| | | | | |
|---|---|---|---|---|
| 2,153,691 | A * | 4/1939 | Hironka | 123/48 B |
| 2,316,399 | A * | 4/1943 | Brouse | 74/600 |
| 4,687,348 | A * | 8/1987 | Naruoka et al. | 384/255 |
| 4,721,073 | A * | 1/1988 | Naruoka et al. | 123/78 BA |
| 4,830,517 | A * | 5/1989 | Naruoka et al. | 384/255 |
| 4,876,992 | A * | 10/1989 | Sobotowski | 123/48 R |
| 6,581,552 | B2 * | 6/2003 | Kreuter | 123/48 R |

* cited by examiner

*Primary Examiner* — Rinaldi Rada
*Assistant Examiner* — Charles Brauch
(74) *Attorney, Agent, or Firm* — Morgan, Lewis & Bockius LLP

(57) ABSTRACT

A variable compression ratio apparatus may include a connecting rod rotatably connected to the piston and the other end being eccentrically and rotatably connected to the crankshaft, an eccentric bearing link, a control link having both ends and a middle portion, the one end being rotatably connected to the other end of the eccentric bearing link, a first shake link having both ends, the one end being rotatably connected to the middle portion of the control link, a second shake link having both ends, the one end being rotatably connected to the other end of the control link, and a control shaft eccentrically connected to a first eccentric cam rotatably connected to the other end of the first shake link and a second eccentric cam rotatably connected to the other end of the second shake link respectively, and rotating together with the first and second eccentric cams.

11 Claims, 4 Drawing Sheets

VARIABLE COMPRESSION RATIO APPARATUS

CROSS-REFERENCE TO RELATED APPLICATION

The present application claims priority to Korean Patent Application No. 10-2010-0063135 filed in the Korean Intellectual Property Office on Jun. 30, 2010, the entire contents of which is incorporated herein for all purposes by this reference.

BACKGROUND OF THE INVENTION

1. Field of the Invention

The present invention relates to a variable compression ratio apparatus. More particularly, the present invention relates to a variable compression ratio apparatus which changes compression ratio of an air-fuel mixture in a combustion chamber according to a driving condition of an engine.

2. Description of Related Art

Generally, thermal efficiency of combustion engines increases as the compression ratio thereof increases, and if ignition timing is advanced to some degree, thermal efficiency of spark-ignition engines increases. However, if the ignition timing of the spark-ignition engines is advanced at a high compression ratio, abnormal combustion may occur and the engine may be damaged. Thus, the ignition timing cannot be excessively advanced and accordingly engine output may deteriorate.

A variable compression ratio (VCR) apparatus changes the compression ratio of an air-fuel mixture according to a driving condition of the engine. The variable compression ratio apparatus raises the compression ratio of the air-fuel mixture at a low-load condition of the engine in order to improve fuel mileage. On the contrary, the variable compression ratio apparatus lowers the compression ratio of the air-fuel mixture at a high-load condition of the engine in order to prevent occurrence of knocking and improve engine output.

According to a conventional variable compression ratio apparatus, a variable compression ratio is achieved by changing a length of a connecting rod which connects a piston to a crankshaft. Such types of a variable compression ratio apparatus include a plurality of links connecting a piston with the crankshaft, and combustion force is directly transmitted to the links. So, durability of the links deteriorates.

It become known to a person skilled in the art through various experimental results conducted to a conventional variable compression ratio apparatus that operation reliability is high in a case that a distance between a crank pin and a piston pin is changed by using an eccentric bearing. If hydraulic pressure, however, is used for rotating the eccentric bearing, a rotating angle of the eccentric bearing in each cylinder or hydraulic pressure applied to each cylinder is different. So, a compression ratio in a cylinder is different from that in another cylinder and a time required for changing the compression ratio according to the driving condition of the engine is varied in each cylinder.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable compression ratio apparatus having advantages of changing compression ratio of an air-fuel mixture as a consequence of mounting an eccentric bearing in a connecting rod and rotating the eccentric bearing by using link members and to minimize the combustion force of the air-fuel mixture transmitted to the link members by kinematically separating a connecting rod from the link members.

In an aspect of the present invention, the variable compression ratio apparatus which may be mounted at an engine receiving combustion force of an air-fuel mixture from a piston and rotating a crankshaft, and which changes compression ratio of the air-fuel mixture, may include a connecting rod having a mounting hole formed at one end thereof, the one end being rotatably connected to the piston through a piston pin inserted in the mounting hole and the other end being eccentrically and rotatably connected to the crankshaft, an eccentric bearing link having one end concentrically and rotatably mounted in the mounting hole and the other end, the piston pin being eccentrically and rotatably mounted in the one end of the eccentric bearing link, a control link having both ends and a middle portion, the one end being rotatably connected to the other end of the eccentric bearing link, a first shake link having both ends, the one end being rotatably connected to the middle portion of the control link, a second shake link having both ends, the one end being rotatably connected to the other end of the control link, and a control shaft eccentrically connected to a first eccentric cam rotatably connected to the other end of the first shake link and a second eccentric cam rotatably connected to the other end of the second shake link respectively, and rotating together with the first and second eccentric cams.

The one end of the eccentric bearing link may be provided with an eccentric bearing inserted and rotating in the mounting hole, and the piston pin may be eccentrically and rotatably mounted in the eccentric bearing.

The first and second eccentric cams may be monolithically formed with the control shaft.

The first and second eccentric cams may be eccentric in an opposite direction with respect to the control shaft.

The eccentric bearing link may include first and second eccentric bearing links, one end portion of the control link may be divided longitudinally into first and second branches, and the other ends of the first and second eccentric bearing links may be rotatably connected respectively to the first and second branches, wherein a guide groove may be formed longitudinally between the first and second branches to receive the connecting rod therein, and the guide groove prevents interference between a movement of the connecting rod and a movement of the control link.

The eccentric bearing may include first and second eccentric bearings, and the first and second eccentric bearings may be formed respectively at the one ends of the first and second eccentric bearing links, wherein the first and second eccentric bearings may be inserted in the mounting hole in an opposite direction to each other.

In another aspect of the present invention, a variable compression ratio apparatus which may be mounted at an engine receiving combustion force of an air-fuel mixture from a piston and rotating a crankshaft, and which changes compression ratio of the air-fuel mixture, may include a connecting rod connecting the piston with the crankshaft so as to transmit combustion force of the air-fuel mixture to the crankshaft, and rotatably connected to the piston through a piston pin, a control shaft rotating according to a driving condition of the engine, first and second shake links eccentrically and rotatably connected to the control shaft, respectively, a control link rotatably connected to the first and second shake links at different positions so as to generate horizontal movement with respect to the control shaft, and an eccentric bearing link having one end connected to the control link so as to rotate according to the horizontal movement of the control link, wherein the other end of the eccentric bearing link may be provided with an eccentric bearing, the eccentric bearing may be concentrically mounted and rotates in a mounting hole formed at the connecting rod, and the piston pin may be eccentrically inserted in the eccentric bearing so as to connect the connecting rod with the piston.

The control shaft may be formed of first and second eccentric cams eccentrically connected respectively to the first and second shake links.

The first and second eccentric cams may be eccentric in an opposite direction with respect to the control shaft.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
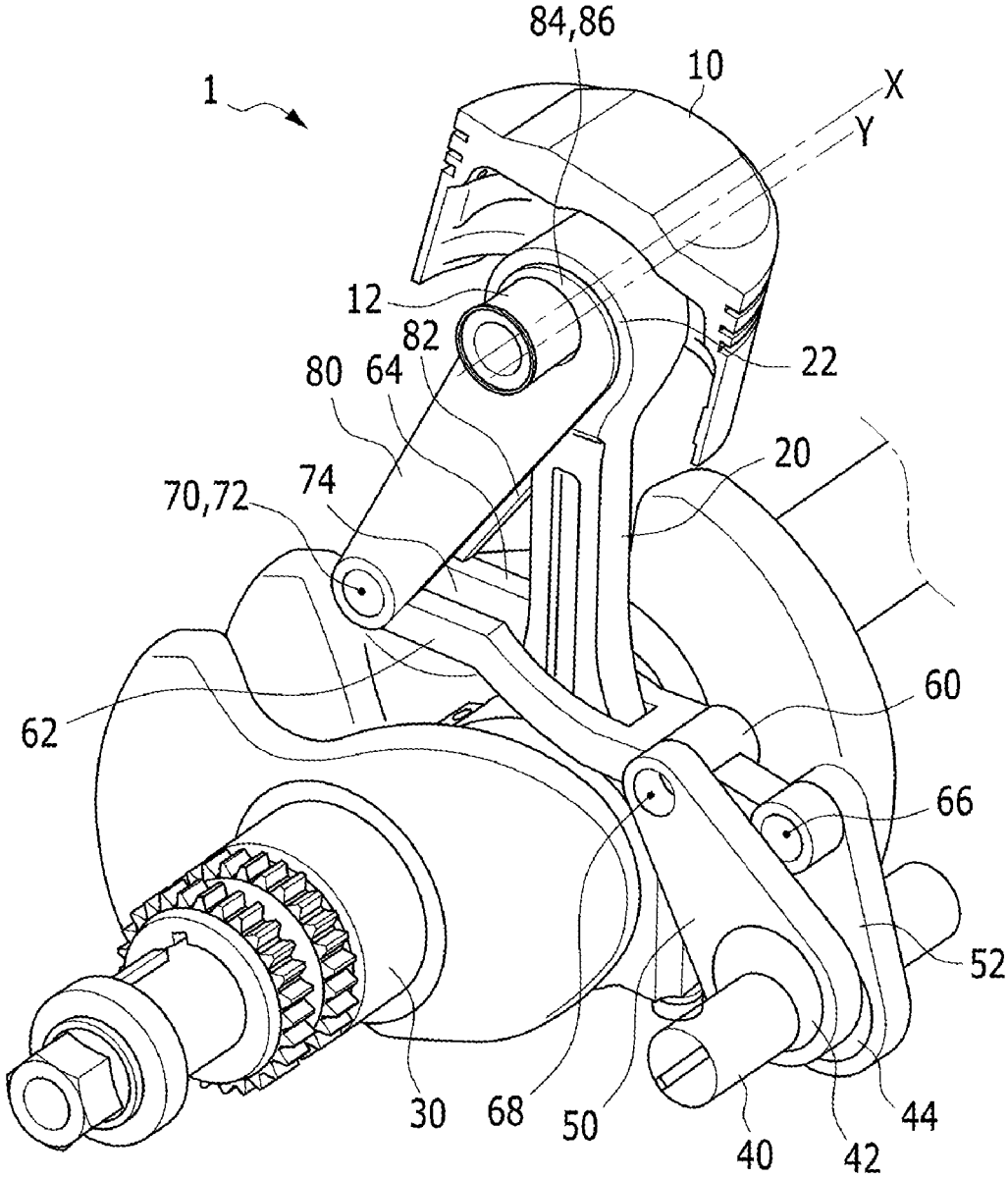
FIG. 1 is a perspective view of a variable compression ratio apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

Figure 2:
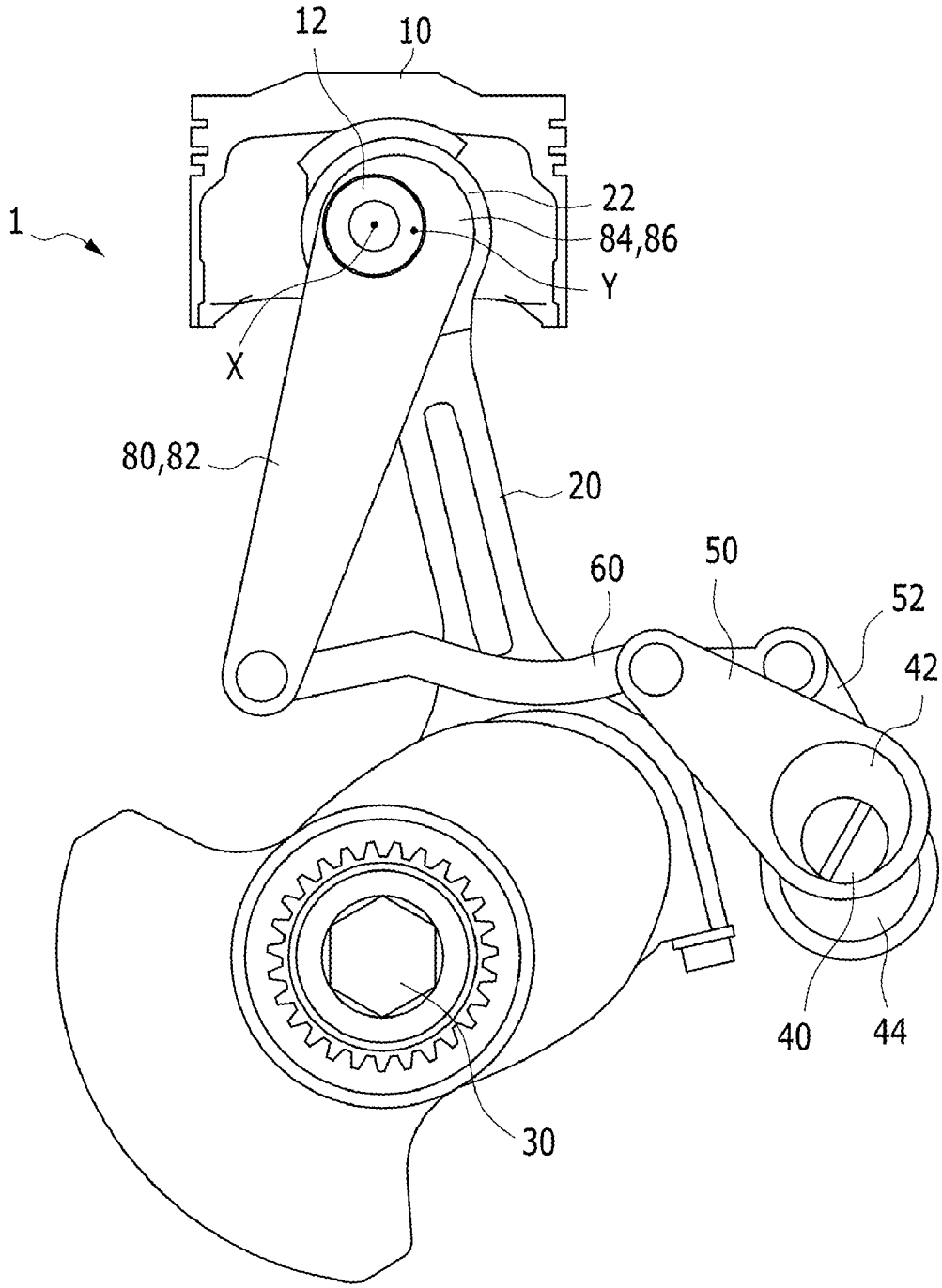
FIG. 2 is a side view of a variable compression ratio apparatus according to an exemplary embodiment of the present invention.

FIG. 1 is a perspective view of a variable compression ratio apparatus according to an exemplary embodiment of the present invention, and FIG. 2 is a side view of a variable compression ratio apparatus according to an exemplary embodiment of the present invention.

As shown in FIG. 1 and FIG. 2, a variable compression ratio apparatus 1 according to an exemplary embodiment of the present invention is mounted at an engine which receives combustion force of an air-fuel mixture from a piston 10 and rotates a crankshaft 30. The variable compression ratio apparatus 1 changes compression ratio of the air-fuel mixture.

The piston 10 moves upward or downward in a cylinder and a combustion chamber is formed between the piston 10 and a cylinder.

The crankshaft 30 receives the combustion force from the piston 10 and transmits torque to a transmission after converting the combustion force into the torque. The crankshaft 30 is mounted in a crank case formed at a lower portion of the cylinder.

The variable compression ratio apparatus 1 includes a connecting rod 20, eccentric bearing links 80 and 82, a control link 60, a first shake link 50, a second shake link 52, and a control shaft 40.

The connecting rod 20 receives the combustion force from the piston 10 and transmits the combustion force to the crankshaft 30. The connecting rod 20 is similar to a conventional connecting rod. For this purpose, one end of the connecting rod 20 is rotatably connected to the piston 10 through a piston pin 12, and the other end of the connecting rod 20 is eccentrically and rotatably connected to the crankshaft 30. In addition, a mounting hole 22 through which the piston pin 12 penetrates is formed at the one end of the connecting rod 20. Since the connecting rod 20 similar to the conventional connecting rod is used, a structure of a conventional engine may not be changed so as to mount the variable compression ratio apparatus 1. In addition, durability of link members may improves by transmitting the combustion force of the air-fuel mixture directly to the connecting rod 20.

A pair of eccentric bearing links 80 and 82 includes both ends respectively, and one end of the pair of eccentric bearing links 80 and 82 are rotatably connected to the one end of the connecting rod 20. For this purpose, an eccentric bearing 84 and 86 is integrally formed at the one end of the eccentric bearing link 80 and 82, and a pair of the eccentric bearings 84 and 86 are concentrically inserted in the mounting hole 22 from both ends of the connecting rod 20. In addition, the piston pin 12 is eccentrically inserted in the eccentric bearing 84 and 86 so as to rotatably connect the piston 10 with the connecting rod 20. That is, a central axis Y of the eccentric bearing 84 and 86 (it is the same as a central axis of the mounting hole 22) is parallel to a central axis X of the piston pin 12 and is disposed apart from the central axis X by a predetermined distance. Therefore, if the eccentric bearing 84 and 86 rotates, a relative displacement of a center of the mounting hole 22 to a piston pin 12 is not changed, and thereby a position of the piston pin 12 to a crank pin is changed. Therefore, the compression ratio of the air-fuel mixture is changed. It is exemplarily shown in this specification that the eccentric bearings 84 and 86 are integrally formed with the eccentric bearing links 80 and 82 respectively, but the spirit of the present invention is not limited to this. That is, the eccentric bearing links 80 and 82 may be manufactured separately from the eccentric bearings 84 and 84 and assembled to the eccentric bearings 84 and 84.

The control link 60 pushes or pulls the eccentric bearing links 80 and 82 so as to rotate the eccentric bearings 84 and 86. For this purpose, the control link 60 includes both ends and a middle portion, and one end portion of the control link 60 is divided longitudinally so as to form first and second branches 62 and 64. That is, the first and second branches 62 and 64 are joined at the middle portion of the control link 60, and the other end of the control link 60 extends to the right in the drawings. In addition, a guide groove 74 is formed longitudinally between the first and second branches 62 and 64 such that the connecting rod 20 moves along the guide groove 74. Therefore, the guide groove 74 prevents interference between a movement of the connecting rod 20 and a movement of the control link 60. Since the interference between the movement of the connecting rod 20 and the movement of the control link 60 is prevented, a transverse movement of the control link 60 may be increased. Therefore, even if the control shaft 40 rotates in one direction, high compression ratio and low compression ratio may occur alternately.

In addition, first, second, third, and fourth connecting points 66, 68, 70, and 72 for connecting the first and second shake links 50 and 52 and the pair of eccentric bearing links 80 and 82 are positioned respectively at the other end and the middle portion of the control link 60 and the first and second branches 62 and 64.

The third connecting point 70 is positioned at one end of the first branch 62 such that the other end of the eccentric bearing link 80 is rotatably connected to the third connecting point 70, and the fourth connecting point 72 is positioned at one end of the second branch 64 such that the other end of the eccentric bearing link 82 is rotatably connected to the fourth connecting point 72.

The first and second shake links 50 and 52 transmit a control force to the control link 60 such that the control link 60 moves transversely. For this purpose, one end of the first shake link 50 is rotatably connected to the middle portion of the control link 60 at the second connecting point 68, and one end of the second shake link 52 is rotatably connected to the other end of the control link 60 at the first connecting point 66.

The control shaft 40 includes first and second eccentric cams 42 and 44. The first and second eccentric cams 42 and 44 are formed eccentrically to the control shaft 40 and rotate together with the control shaft 40. In addition, the first and second eccentric cams 42 and 44 are eccentric in an opposite direction with respect to the control shaft 40. The other end of the first shake link 50 is rotatably connected to the first eccentric cam 42, and the other end of the second shake link 52 is rotatably connected to the second eccentric cam 44. Since the first and second eccentric cams 42 and 44 are eccentric in the opposite direction with respect to the control shaft 40, the first and second shake links 50 and 52 minimizes a vertical movement of the control link 60 and maximizes a transverse movement of the control link 60. If the vertical movement of the control link 60 is large, the control link 60 may be interfered with the crankshaft 30 and a cylinder liner. Therefore, degree of freedom in design may be increased by minimizing the vertical movement of the control link 60.

The variable compression ratio apparatus 1 according to an exemplary embodiment of the present invention may further include a control portion. The control portion changes the compression ratio of the air-fuel mixture according to a driving condition of the engine. For this purpose, the control portion rotates the control shaft 40 through driving means such as a motor.

Meanwhile, it is exemplarily shown in this specification that a pair of eccentric bearing links is used, but only one eccentric bearing link may be used. In this case, the one end portion of the control link 60 is not divided, and the control link 60 is positioned at a side portion of the connecting rod 20.

Hereinafter, an operation of the variable compression ratio apparatus according to an exemplary embodiment of the present invention will be described referring to FIG. 3 and FIG. 4.

Figure 3:
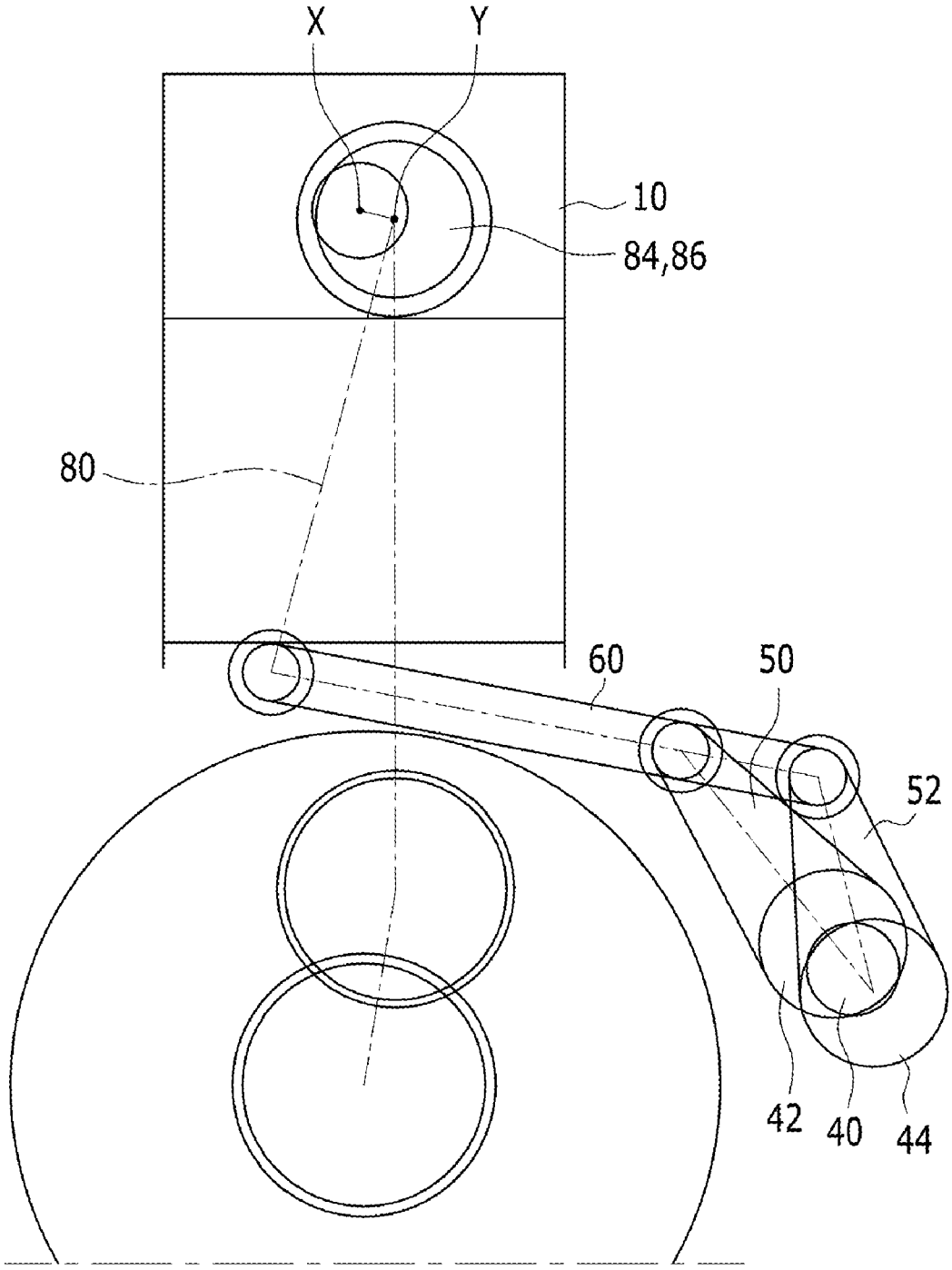
FIG. 3 is a schematic diagram showing that a variable compression ratio apparatus according to an exemplary embodiment of the present invention is operated at a high compression ratio.
Figure 4:
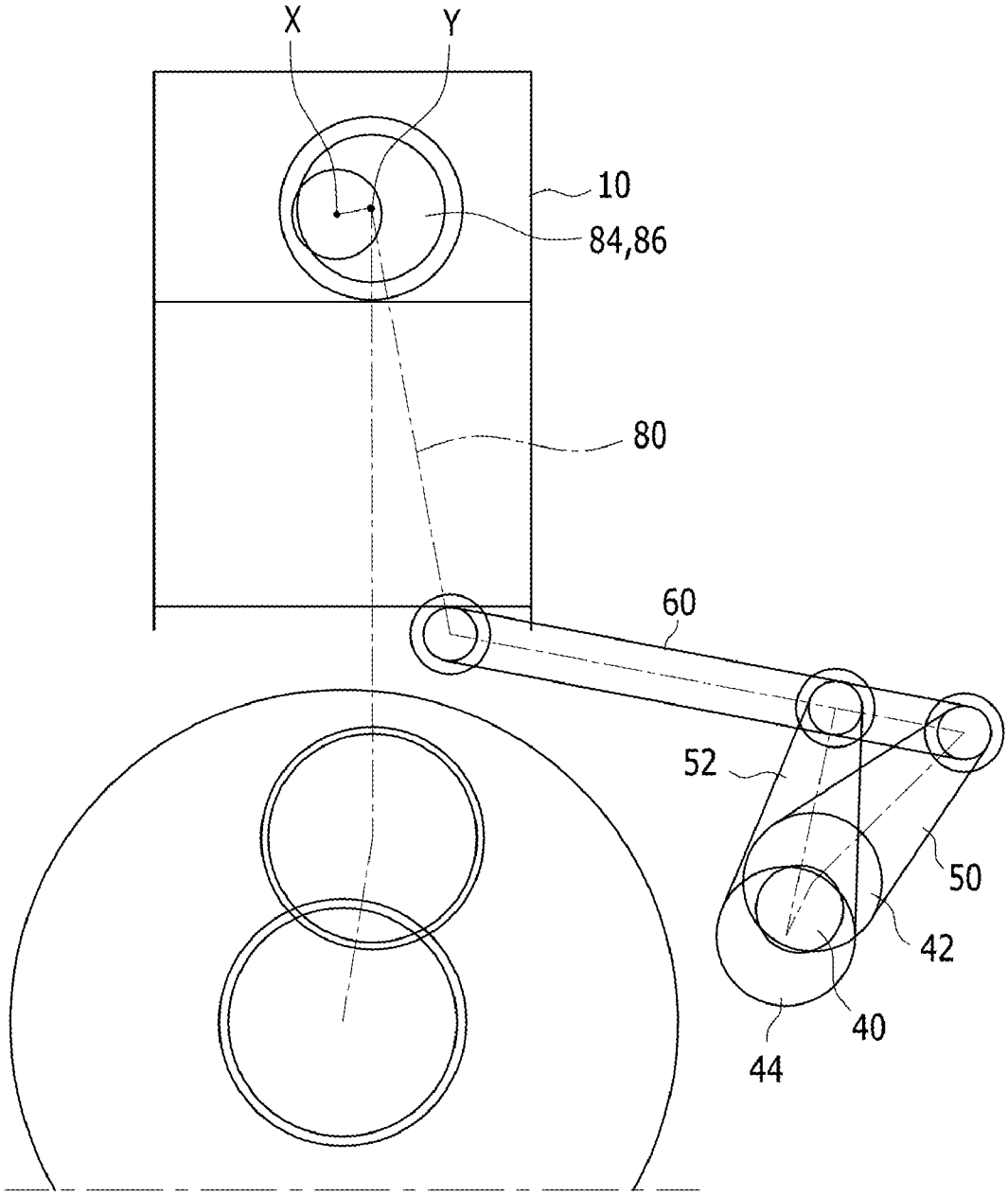
FIG. 4 is a schematic diagram showing that a variable compression ratio apparatus according to an exemplary embodiment of the present invention is operated at a low compression ratio.

FIG. 3 is a schematic diagram showing that a variable compression ratio apparatus according to an exemplary embodiment of the present invention is operated at a high compression ratio, and FIG. 4 is a schematic diagram showing that a variable compression ratio apparatus according to an exemplary embodiment of the present invention is operated at a low compression ratio.

If the control shaft 40 rotates clockwise in a case that the variable compression ratio apparatus 1 operates at a high compression ratio as shown in FIG. 3, the first and second shake links 42 and 44 eccentrically connected to the control shaft 40 pulls the control link 60 to the right in the drawing. Accordingly, the control link 60 rotates the eccentric bearings 84 and 86 formed at the eccentric bearing links 80 and 82 counterclockwise, and a position of the piston pin 12 is lowered. Therefore, a distance between the piston pin 12 and the crank pin is shortened and a low compression ratio may be achieved as shown in FIG. 4.

If the control shaft 40 rotates counterclockwise in a case that the variable compression ratio apparatus 1 operates at the low compression ratio as shown in FIG. 4, the first and second shake links 42 and 44 eccentrically connected to the control shaft 40 pushes the control link 60 to the left in the drawing. Accordingly, the control link 60 rotates the eccentric bearings 84 and 86 formed at the eccentric bearing links 80 and 82 clockwise, and the position of the piston pin 12 is raised. Therefore, the distance between the piston pin 12 and the crank pin becomes longer and the high compression ratio may be achieved as shown in FIG. 3.

As described above, since a connecting rod similar to a conventional connecting rod is used according to an exemplary embodiment of the present invention, a variable compression ratio apparatus may be installed without change in a structure of a conventional engine.

In addition, durability of link members may be improved as a consequence of transmitting combustion force of an air-fuel mixture to the connecting rod directly.

Since a guide groove prevents interference between a movement of the connecting rod and a movement of a control link, a transverse movement of the control link may be maximized. Therefore, even if a control shaft rotates in one direction, high compression ratio and low compression ratio may occur alternately.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio apparatus which is mounted at an engine receiving combustion force of an air-fuel mixture from a piston and rotating a crankshaft, and which changes compression ratio of the air-fuel mixture, the variable compression ratio apparatus comprising:

a connecting rod having a mounting hole formed at one end thereof, the one end being rotatably connected to the piston through a piston pin inserted in the mounting hole and the other end being eccentrically and rotatably connected to the crankshaft;

an eccentric bearing link having one end concentrically and rotatably mounted in the mounting hole and the other end, the piston pin being eccentrically and rotatably mounted in the one end of the eccentric bearing link;

a control link having both ends and a middle portion, the one end being rotatably connected to the other end of the eccentric bearing link;

a first shake link having both ends, the one end being rotatably connected to the middle portion of the control link;

a second shake link having both ends, the one end being rotatably connected to the other end of the control link; and a control shaft eccentrically connected to a first eccentric cam rotatably connected to the other end of the first shake link and a second eccentric cam rotatably connected to the other end of the second shake link respectively, and rotating together with the first and second eccentric cams.

2. The variable compression ratio apparatus of claim 1, wherein the one end of the eccentric bearing link is provided with an eccentric bearing inserted and rotating in the mounting hole, and the piston pin is eccentrically and rotatably mounted in the eccentric bearing.

3. The variable compression ratio apparatus of claim 2, wherein the eccentric bearing link comprises first and second eccentric bearing links, one end portion of the control link is divided longitudinally into first and second branches, and the other ends of the first and second eccentric bearing links are rotatably connected respectively to the first and second branches.

4. The variable compression ratio apparatus of claim 3, wherein a guide groove is formed longitudinally between the first and second branches to receive the connecting rod therein, and the guide groove prevents interference between a movement of the connecting rod and a movement of the control link.

5. The variable compression ratio apparatus of claim 3, wherein the eccentric bearing comprises first and second eccentric bearings, and the first and second eccentric bearings are formed respectively at the one ends of the first and second eccentric bearing links.

6. The variable compression ratio apparatus of claim 5, wherein the first and second eccentric bearings are inserted in the mounting hole in an opposite direction to each other.

7. The variable compression ratio apparatus of claim 1, wherein the first and second eccentric cams are monolithically formed with the control shaft.

8. The variable compression ratio apparatus of claim 1, wherein the first and second eccentric cams are eccentric in an opposite direction with respect to the control shaft.

9. A variable compression ratio apparatus which is mounted at an engine receiving combustion force of an air-fuel mixture from a piston and rotating a crankshaft, and which changes compression ratio of the air-fuel mixture, the variable compression ratio apparatus comprising:

a connecting rod connecting the piston with the crankshaft so as to transmit combustion force of the air-fuel mixture to the crankshaft, and rotatably connected to the piston through a piston pin;

a control shaft rotating according to a driving condition of the engine;

first and second shake links eccentrically and rotatably connected to the control shaft, respectively;

a control link rotatably connected to the first and second shake links at different positions so as to generate horizontal movement with respect to the control shaft; and an eccentric bearing link having one end connected to the control link so as to rotate according to the horizontal movement of the control link, wherein the other end of the eccentric bearing link is provided with an eccentric bearing, the eccentric bearing is concentrically mounted and rotates in a mounting hole formed at the connecting rod, and the piston pin is eccentrically inserted in the eccentric bearing so as to connect the connecting rod with the piston.

10. The variable compression ratio apparatus of claim 9, wherein the control shaft is formed of first and second eccentric cams eccentrically connected respectively to the first and second shake links.

11. The variable compression ratio apparatus of claim 10, wherein the first and second eccentric cams are eccentric in an opposite direction with respect to the control shaft.

* * * * *